US005230168A

United States Patent [19]

Heinzmann et al.

[11] Patent Number: 5,230,168

[45] Date of Patent: Jul. 27, 1993

[54] VACUUM GENERATION IN THE POCKET OF A SINGLE WIRE DRYER GROUP

[75] Inventors: Helmut Heinzmann, Böhmenkirch; Bernhard Kohl, Heidenheim, both of Fed. Rep. of Germany

[73] Assignee: J. M. Voith GmbH, Fed. Rep. of Germany

[21] Appl. No.: 782,000

[22] Filed: Oct. 22, 1991

[30] Foreign Application Priority Data

Oct. 25, 1990 [DE] Fed. Rep. of Germany ..... 4033901

[51] Int. Cl.[5] ..... F26B 13/08

[52] U.S. Cl. ..... 34/117; 34/120

[58] Field of Search ..... 34/117, 115, 116, 120, 34/114

[56] References Cited

U.S. PATENT DOCUMENTS 4,359,828 11/1982 Thomas .

*Primary Examiner*—Henry A. Bennett

*Attorney, Agent, or Firm*—Ostrolenk, Faber, Gerb & Soffen

[57] ABSTRACT

In a single wire dryer group, a paper web travels on one side of a support belt over a first dryer cylinder, then over a guide roll, then over a second dryer cylinder moving through the dryer group. A pocket is defined between the two adjacent dryer cylinders and the guide roll between them. To develop a vacuum within the pocket in the vicinity of the outer surface of the first dryer cylinder, there is a sealing ledge at the support belt at the first dryer cylinder. The sealing ledge is fastened to a sealing ledge support. An air guide surface on the side of the sealing ledge support away from the pocket is curved first in a direction toward the bottom of the pocket and then away from the pocket around axes above the air guide surface. Toward the second cylinder, the sealing ledge support defines an air ejector nozzle. A first air flow induced on the first dryer cylinder is deflected upward around and past the ejector nozzle by the curvature of the air guide surface. A second air flow traveling along the support belt past the second dryer cylinder is induced to pass through and exits through the nozzle. The first and second air flows are then combined at the outlet from the ejector nozzle.

8 Claims, 2 Drawing Sheets

VACUUM GENERATION IN THE POCKET OF A SINGLE WIRE DRYER GROUP

BACKGROUND OF THE INVENTION

The present invention relates to a single-wire dryer group of a paper making machine and particularly to air deflection means within a pocket of the dryer group for generating a vacuum there.

A single wire dryer group has a plurality of dryer cylinders. The web to be dried moves over the cylinders in sequence. A respective guide roll is disposed between each two cylinders in the path of the web. A porous support belt, e.g. a wire screen or wire, carries the web to be dried from one dryer cylinder to a succeeding guide roll and then to the next dryer cylinder in the path of the web through the dryer group. The web is carried on the side of the support belt that places the web in direct contact with the dryer cylinders and that also places the web on the outside of the support belt as it passes over the guide rolls. Features of such a single wire dryer group are disclosed in U.S. Pat. No. 4,359,828, particularly FIG. 7, for example. Such a dryer is preferably part of a paper making machine.

In a single-wire dryer group, the web to be dried, which is a web of paper, is guided continuously by the porous support belt and is pressed directly against the dryer cylinders. The web and the support belt travel, for instance, from a first dryer cylinder jointly over the shortest possible path to the following guide roll and from the latter back to a second dryer cylinder and then over a second guide roll to a third dryer cylinder, etc. The volume bounded by two neighboring dryer cylinders and the guide roll between them is called the pocket. Typically, the guide roll axis is off an imaginary line between the axes of the two cylinders and the pocket is to the side of that line toward the guide roll axis.

The guide roll can be arranged in a symmetrical arrangement at an equal distance from each of the two adjacent dryer cylinders. However, an asymmetric arrangement is known in which the smallest possible distance is provided between the first dryer cylinder and the guide roll while a substantially greater distance is provided between the guide roll and the second dryer cylinder.

Upon the web leaving the first dryer cylinder, it is essential that the web not adhere to the cylinder, but that the web instead be drawn against the support belt by a vacuum produced in the pocket. Also, the web must be drawn against the support belt in the wrapping zone around the guide roll, in opposition to the centrifugal force acting on the web. This can be achieved, for instance, by producing the guide roll with circumferential grooves into which the vacuum produced in the pocket is propagated. Alternatively, the guide roll is formed as a suction roll, with or without an inner stationary suction box, and the shell of the roll is perforated. It is also important that the web be dependably held against the support belt along the path of the web from the guide roll to the second dryer cylinder by the vacuum prevailing in the pocket.

In FIG. 7 of U.S. Pat. No. 4,359,828, production of a vacuum in the pocket is attempted by the following measures. A first sealing ledge, which is fastened to a sealing ledge support, is arranged in the pocket in the vicinity of the outer surface of the first dryer cylinder. Similarly, a second sealing ledge, which is also fastened to a sealing ledge support, is arranged in the vicinity of the outer surface of the second dryer cylinder. The two sealing ledge supports are curved in such a manner that they deflect the flow of air that is induced by the traveling support belt on the first dryer cylinder into the direction in which the support belt travels over the second dryer cylinder. Together with an additional flow guide wall, the two sealing ledge supports form a flow channel which has an ejector like opening through which air is drawn upward out of the pocket. In this way, a certain vacuum can prevail in the pocket. The strength of this vacuum is, however, insufficient in actual practice.

SUMMARY OF THE INVENTION

The object of the invention is to develop the known arrangement in a single wire dryer group to produce a substantially greater vacuum than the level of vacuum previously present in the pocket.

In a single wire dryer group, a paper web travels on one side of a support belt directly over a first heatable dryer cylinder, then outside the support belt over a guide roll, and then over a second dryer cylinder. A pocket is defined between the two adjacent dryer cylinders and the guide roll between them. A vacuum is to be developed within the pocket. In the vicinity of the outer surface of the first or upstream dryer cylinder, there is a sealing ledge at the support belt. The sealing ledge is fastened to a sealing ledge support that extends between the dryer cylinders and is above the guide roll. An air guide surface is defined on the sealing ledge support at its side away from the pocket and away from the guide roll. The sealing ledge support air guide surface is curved around axes above that surface, first in a direction toward the bottom of the pocket and then away from the bottom of the pocket, that is first generally in the direction along the path of the support belt past the first cylinder and toward the bottom of the pocket, and then toward the second cylinder and generally in the direction along the path of the support belt past the second cylinder. The sealing ledge support defines an air ejector nozzle at the second dryer cylinder. Air flow induced on the support belt at the first dryer cylinder is deflected off the support belt, upward around and past the ejector nozzle by the curvature of the sealing ledge support air guide surface. A second air flow that travels along the support belt past the second dryer cylinder is induced to pass through and exits through the nozzle. The first and second air flows are then combined at the outlet from the ejector nozzle.

In the invention, only a single sealing ledge is provided, and it is located on the shell of the first dryer cylinder. Thus, only a single sealing ledge support is necessary. Furthermore, an ejector like opening serving for the removal of air from the pocket is no longer formed between two sealing ledge supports, but rather is formed between the single sealing ledge support and the outer surface of the second dryer cylinder which is covered by the support belt. The invention uses the flow of air which the support belt induces at its normally high operating speeds (about 1,000 to 2,000 m/min) over the relatively short travel path of the support belt from the guide roll to the second dryer cylinder. This flow of air is referred to below as the "second air flow", while the flow of air induced by the support belt on the first dryer cylinder is referred to below as the "first air flow".

The two air flows are combined by an ejector like opening, which is also referred to as an "ejector nozzle", between the sealing ledge support and the shell of the second dryer cylinder, and particularly the support belt passing over the second dryer cylinder. In this connection, at least the second air flow, which is induced by the pumping action of the support belt or wire traveling from the guide roll to the second dryer cylinder, produces a vacuum in the pocket of an amount which in many cases is sufficient for dependable operation of the single wire dryer group.

Supporting measures for attaining this goal may be:

A. Omission of the additional flow guide wall which was previously present and which would tend to exert a braking action on the first air flow.

B. A flow favoring shape of the sealing ledge and of the sealing ledge support so that the first air flow is braked as little as possible.

C. In accordance with a further concept of the invention, acceleration of the first air flow can even be obtained on the sealing ledge support, by increasing the curvature of the air flow guide surface of the sealing ledge support in the direction of flow. In other words, the radius of curvature of the flow guide surface decreases in the direction of flow. In this case, it is possible for the flow guide surface to have a flat initial part in the region of the sealing ledge. The acceleration of the first air flow produces a suction effect at the ejector nozzle on the air present in the pocket, increasing the vacuum produced there.

In a further embodiment of the invention, provision is made to minimize problems which may arise in cases of disturbance, e.g. in the event of a web break resulting in the danger that the web might wind itself on one of the dryer cylinders or to minimize problems in the event that the support belt tears. The sealing ledge support is swingably mounted so that the sealing ledge can be moved away from the first dryer cylinder. At the same time, the ejector like opening between the sealing ledge support and the second dryer cylinder is increased in size. As a result, e.g. in the event of a web break, the danger that the support belt tears is minimized. If, nevertheless, in a certain event, the support belt should tear, the danger of damage to the dryer cylinders and to the guide roll is avoided. Furthermore, the introduction of a new support belt is facilitated. The sealing ledge support can be made automatically swingable by unintended contact of the support belt with the sealing ledge or with the sealing ledge support when both are supported swingably on a support.

The above described features can also be employed in the case of a sealing ledge support which is developed without means for removing air from the pocket.

It is evident that a moveable sealing ledge support must be supported on a support beam which extends transversely to the direction of travel of the web through the pocket. In order to avoid disturbances, large distances are provided between the sealing ledge support and the travel path of the support belt. On the other hand, a wall of the support for the sealing ledge support can be closely adapted to the outer surface of the guide roll and can be arranged at a slight distance from it.

Other objects and features of the invention are disclosed with reference to one embodiment of the invention which is described below with reference to the drawings.

DESCRIPTION OF A PREFERRED EMBODIMENT

Figure 1:
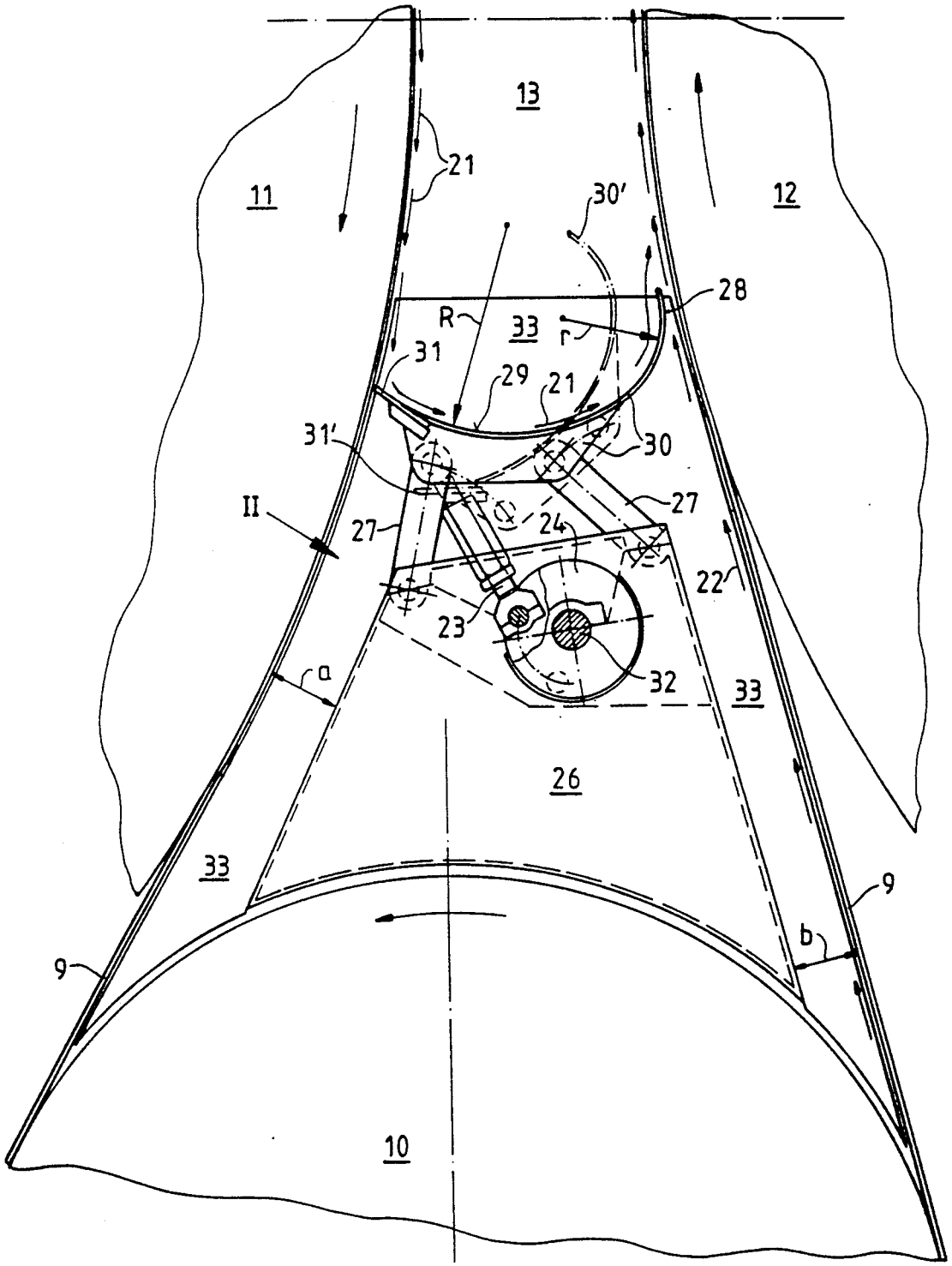
FIG. 1 is a side view of a portion of a single wire dryer group having the sealing ledge provided in a pocket.

FIG. 1 shows two dryer cylinders 11 and 12 of a single wire dryer group of a paper making machine. The cylinders are arranged one after the other in a row and also in the path of a web through the dryer group. A guide roll 10 is present between the cylinders. A support belt 9 travels, together with the web of paper to be dried, from the first dryer cylinder 11 to the guide roll 10 and from the latter to the second dryer cylinder 12. The space between the cylinders, which is also partly closed by the guide roll, is referred to as a "pocket" 13. In the embodiment shown, the two dryer cylinders 11 and 12 are arranged alongside of each other and have rotation axes which are joined by an imaginary line. The guide roll 10 lies below the dryer cylinders, with the rotation axis of the guide roll disposed below the line joining the cylinder axes. However, other arrangements of the two dryer cylinders and the guide roll between them are possible. For instance, the guide roll 10 may be above the dryer cylinders, or the dryer cylinders may be one above the other, so that the guide roll lies to the right or the left of and alongside the dryer cylinders.

The guide roll 10 is shown diagrammatically as a non-aspirated, non-suction roll having a smooth roll shell. However, the roll shell could also be provided with circumferential grooves or with perforations. The guide roll could also be developed as a suction roll, with or without an internal stationary suction box, and the roll shell would also then be provided with perforations.

A sealing ledge 31 is arranged in the pocket in the vicinity of the outer surface of the first dryer cylinder 11. The ledge 31 is fastened to ap1776Xsealedge support 30. The upper side of the support 30 (as seen in the embodiment shown), i.e. the side facing out of the pocket, has an air guide surface 29 which is curved convexly toward the bottom of the pocket, i.e. it has axes of curvature above the air guide surface and out of the pocket. The air guide surface extends from the upper side of the sealing ledge 31 at the first dryer cylinder to close to the outer surface of the second dryer cylinder 12 which is covered by the support belt. The guide surface 29 terminates near the second dryer cylinder in a section of the surface 29 which is approximately parallel to the outer surface of the second dryer cylinder. At least this end section of the air guide surface 29 is formed by a relatively thin plate which is part of the sealing ledge support 31. Together with the outer surface of the second dryer cylinder 12 and particularly with the support belt passing over the second dryer cylinder, the sealing ledge support 31 forms an ejector nozzle 28 there.

The curvature of the air guide surface 29 increases in the direction of flow. In the initial air flow region close to the sealing ledge 31, there is a relatively large radius of curvature R, while in the final section toward the second cylinder 12, there is a relatively small radius of curvature r of the air guide surface.

The arrangement described above operates in the following manner:

The support belt 9 travels on its path over the first dryer cylinder 11. The belt carries along with it, in known manner, an air boundary layer or, in other words, it induces a first air flow 21 which is downward into the pocket. The first air flow 21 is deflected by the sealing ledge 31 and by the curved sealing ledge support 30 to be redirected in the direction in which the support belt 9 travels over the second dryer cylinder 12, i.e. outward from the pocket. The first air flow 21 is therefore substantially prevented from penetrating to the bottom of the pocket 13. It is instead removed from the pocket again. The second air flow 22 which is induced by the support belt 9 on its path from the guide roll 10 to the second dryer cylinder 12 is transported outward from the pocket. In cooperation with the seal provided by the lateral pocket covers 33, which are described below, a reduced air pressure, partial vacuum condition is produced in the pocket 13. This vacuum causes the web of paper which is to be dried to dependably adhere to the porous support belt 9 in the region of the straight path of travel of the support belt between cylinder 11 and guide roll 10, as well as in the region of the path between guide roll 10 and cylinder 12.

The vacuum can be further increased by increasing the curvature of the air guide surface 29 in the direction of flow. This accelerates the first air flow 21. This also increases the speed of the second air flow 22 and thus increases the vacuum produced in the pocket 13.

Figure 2:
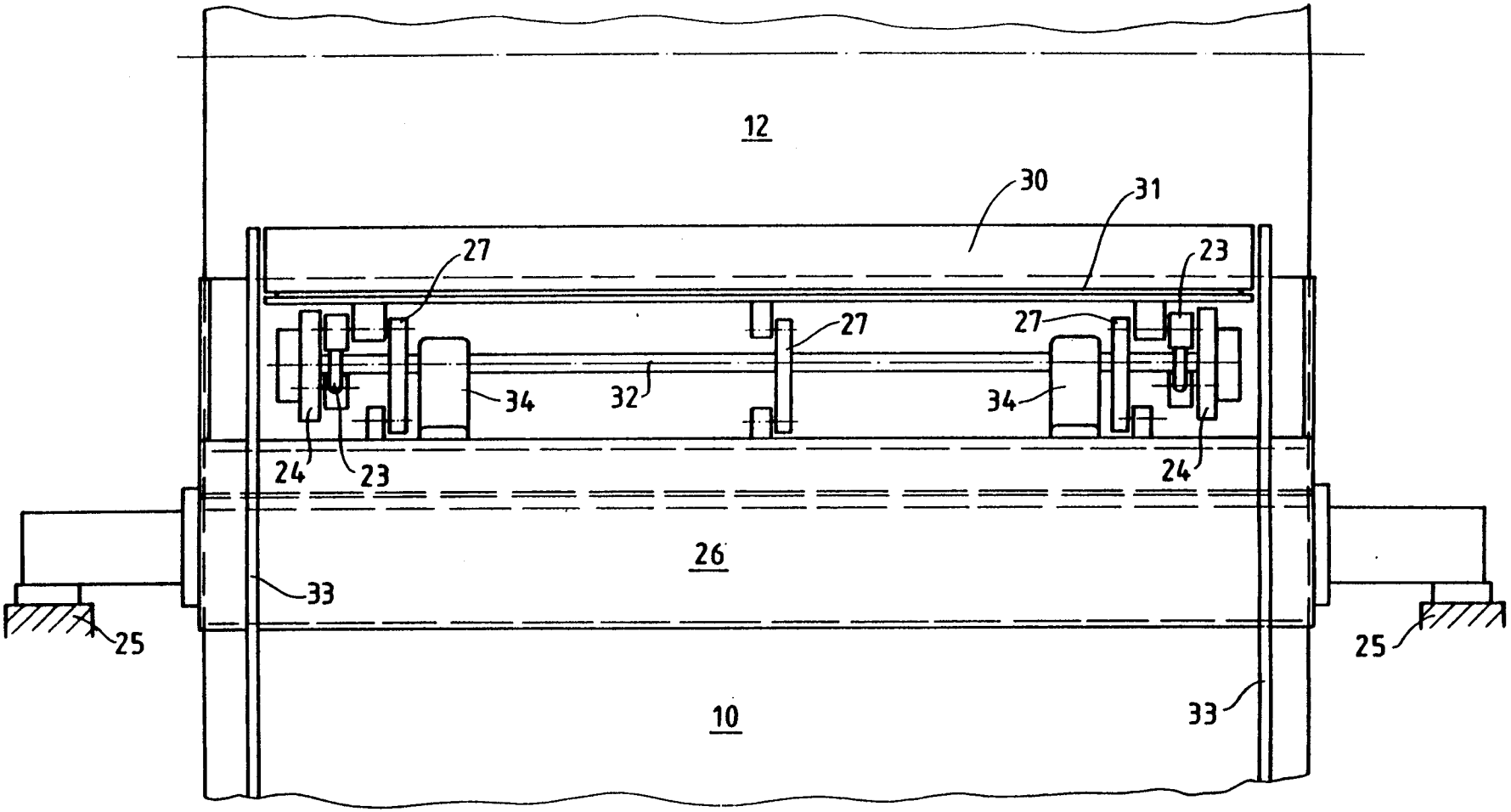
FIG. 2 is a diagrammatically simplified view, shown on a reduced scale as compared with FIG. 1, and seen in the direction of the arrow II of FIG. 1.

The sealing ledge support 30 is mounted by several links 27 which are arranged in pairs at opposite axial ends of the support. The links are swingable on a box shaped support 26 which extends transversely to the direction of travel of the web through the pocket 13. The support 26 is fastened, as shown in FIG. 2, on rigid parts 25 of the housing. The sealing ledge support 30 is furthermore articulately connected by at least one connecting rod 23 to at least one crank, drive disk 24, or the like. The latter is fastened on a shaft 32 which extends parallel to the support 26 and is mounted rotatably on it at bearings 34. This enables the sealing ledge 31 and the sealing ledge support 30 to be swung back and forth between two positions. Their normal operating position is shown in solid line in the drawing. Their other position is shown in dash-dot lines in FIG. 1 and is designated 31' and 30'. In the latter position, the distances between sealing ledge/sealing-ledge support and the dryer cylinders 11 and 12 is substantially greater than in the operating position. The distances a, b between the side walls of the support 26 and the travel paths of the support belt 9 are at all times relatively large, as can be noted from FIG. 1.

Lateral covers 33 which limit the pocket 13 at its two axial ends, i.e. on the operator and the driven sides of the paper making machine, help to maintain the vacuum produced in the pocket because they prevent the lateral drawing-in of infiltrating air.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A single wire dryer group comprising a plurality of dryer cylinders in a path of a web to be dried through the dryer group, a respective guide roll between two neighboring ones of the dryer cylinders in the dryer group, such that a support belt carries the web alternately over a first one of the dryer cylinders, then over a neighboring one of the guide rolls, then over a second one of the dryer cylinders along the path of the web through the dryer group;

the first and the second dryer cylinders and the guide roll between the dryer cylinders forming and defining a pocket;

a sealing ledge support, support means for supporting the sealing ledge support in the pocket, a sealing ledge supported on the sealing ledge support and located near the outer surface of the first dryer cylinder, and the sealing ledge and the sealing ledge support together having an air guide surface facing out of the pocket and positioned so as to deflect over the sealing ledge and onto and over the sealing ledge support a first air flow that is being moved by the support belt traveling over and past the first dryer cylinder; the air guide surface being shaped to deflect the first air flow substantially in a direction over which the support belt is traveling over the second dryer cylinder;

the sealing ledge support being so shaped and spaced from and cooperating with the support belt passing over the second dryer cylinder as to form between them an ejector nozzle for a second air flow traveling out of the pocket with the support belt, whereby the first air flow flows over the sealing ledge support past the ejector nozzle while the second air flow flows over the support belt past the second dryer cylinder, and the second air flow is induced out of the pocket by the traveling support belt passing over the second dryer cylinder for producing a vacuum in the pocket, and the sealing ledge support being so disposed with respect to the second dryer cylinder and the ejector nozzle that the first air flow over the sealing ledge support and the second air flow through the nozzle combine at the outlet of the ejector nozzle.

2. The single wire dryer group of claim 1, wherein the first and the second dryer cylinders have respective rotation axes, and the guide roll has a rotation axis that is off to one side of a line joining the rotation axes of the first and second dryer cylinders, and the pocket being toward the one side of the line joining the axes of the dryer cylinders between the first and second dryer cylinders and the guide roll.

3. The single wire dryer group of claim 1, further comprising a web support belt passing over the first dryer cylinder, then over the one guide roll and then over the second dryer cylinder, the support belt supporting the web to be dried on the side of the belt such that the web is in direct contact with the first and second dryer cylinders while the support belt passes between the web and the guide roll.

4. A single wire dryer group comprising a plurality of dryer cylinders in a path of a web to be dried through the dryer group, a respective guide roll between two neighboring ones of the dryer cylinders in the dryer group, such that a support belt carries the web alternately over a first one of the dryer cylinders, then over a neighboring one of the guide rolls, then over a second one of the dryer cylinders along the path of the web through the dryer group;

the first and the second dryer cylinders and the guide roll between the dryer cylinders forming and defining a pocket;

a sealing ledge support, support means for supporting the sealing ledge support in the pocket, a sealing ledge supported on the sealing ledge support and located near the outer surface of the first dryer cylinder, and the sealing ledge and the sealing ledge support together having an air guide surface facing out of the pocket and positioned so as to deflect over the sealing ledge onto and over the sealing ledge support a first air flow that is being moved by the support belt traveling over and past the first dryer cylinder; the air guide surface being curved convexly into the pocket and around axes above the air guide surface to deflect the first air flow substantially in a direction over which the support belt is traveling over the second dryer cylinder;

the sealing ledge support being so shaped and spaced from and cooperating with the support belt passing over the second dryer cylinder as to form between them an ejector nozzle for a second air flow traveling out of the pocket with the support belt, whereby the first air flow flows over the sealing ledge support past the ejector nozzle while the second air flow flows over the support belt past the second dryer cylinder, and the second air flow is induced out of the pocket by the traveling support belt passing over the second dryer cylinder for producing a vacuum in the pocket, and the sealing ledge support belt is so disposed with respect to the second dryer cylinder and the ejector nozzle that the first air flow over the sealing ledge support and the second air flow through the nozzle combine at the outlet of the ejector nozzle.

5. A single wire dryer group comprising a plurality of dryer cylinders in a path of a web to be dried through the dryer group, a respective guide roll between two neighboring ones of the dryer cylinders in the dryer group, such that a support belt carries the web alternately over a first one of the dryer cylinders, then over a neighboring one of the guide rolls, then over a second one of the dryer cylinders along the path of the web through the dryer group;

the first and the second dryer cylinders and the guide roll between the dryer cylinders forming and defining a pocket;

a sealing ledge support, support means for supporting the sealing ledge support i the pocket, a sealing ledge supported on the sealing ledge support and located near the outer surface of the first dryer cylinder, and the sealing ledge and the sealing ledge support together having an air guide surface facing out of the pocket and positioned so as to deflect over the sealing ledge onto and over the sealing ledge support a first air flow that is being moved by the support belt traveling over and past the first dryer cylinder; the air guide surface being shaped to deflect the first air flow substantially in a direction over which the support belt is traveling over the second dryer cylinder; the sealing ledge support being swingably mounted on the support means to enable adjustment of the distance between the sealing ledge and the first dryer cylinder and to enable adjustment of the distance between the sealing ledge support and the second dryer cylinders;

the sealing ledge support being so shaped and spaced from and cooperating with the support belt passing over the second dryer cylinder as to form between them an ejector nozzle for a second air flow traveling out of the pocket with the support belt, whereby the first air flow flows over the sealing ledge support past the ejector nozzle while the second air flow flows over the support belt past the second dryer cylinder, and the second air flow is induced out of the pocket by the traveling support belt passing over the second dryer cylinder for producing a vacuum in the pocket, and the sealing ledge support belt is so disposed with respect to the second dryer cylinder and the ejector nozzle that the first air flow over the sealing ledge support and the second air flow through the nozzle combine at the outlet of the ejector nozzle.

6. This single wire dryer group of claim 4, wherein the radius of curvature of the air guide surface gradually decreases in the direction of the first air flow over the air guide surface toward the second dryer cylinder.

7. The single wire dryer group of claim 5, wherein the swingable mounting for the sealing ledge support yieldably supports the sealing ledge support such that contact of the support belt with one of the sealing ledge and the sealing ledge support swings the sealing ledge support to increase the distances between the contacting parts.

8. The single wire dryer group of claim 1, wherein the sealing ledge support has a section which is adjacent to and approximately parallel with the outer surface of the second dryer cylinder.

* * * * *